US009773412B2

(12) United States Patent
Yoon et al.

(10) Patent No.: US 9,773,412 B2
(45) Date of Patent: Sep. 26, 2017

(54) SYSTEM AND METHOD FOR PROVIDING AUGMENTED REALITY NOTIFICATION

(71) Applicant: Thinkware Corporation, Seongnam-si, Gyeonggi-do (KR)

(72) Inventors: Min Ji Yoon, Seongnam-si (KR); Ye Seul Jeong, Seongnam-si (KR); Youn Joo Shin, Seongnam-si (KR); Won Jun Heo, Seongnam-si (KR)

(73) Assignee: Thinkware Corporation, Seongnam-si (KR)

( * ) Notice: Subject to any disclaimer, the term of this patent is extended or adjusted under 35 U.S.C. 154(b) by 50 days.

(21) Appl. No.: 14/799,237

(22) Filed: Jul. 14, 2015

(65) Prior Publication Data

US 2016/0019786 A1 Jan. 21, 2016

(30) Foreign Application Priority Data

Jul. 17, 2014 (KR) ..... 10-2014-0090288

(51) Int. Cl.
*G08G 1/09* (2006.01)
*G08G 1/0962* (2006.01)

(52) U.S. Cl.
CPC ..... *G08G 1/0962* (2013.01)

(58) Field of Classification Search
CPC ..... G08G 1/0962
USPC ..... 340/905; 701/400, 410, 418, 436, 439; 345/633
See application file for complete search history.

(56) References Cited

U.S. PATENT DOCUMENTS

| | | | | |
|---|---|---|---|---|
| 7,073,129 | B1 * | 7/2006 | Robarts | G06Q 10/10 463/36 |
| 8,032,273 | B2 * | 10/2011 | Yang | G01C 21/26 340/425.5 |
| 8,471,691 | B2 * | 6/2013 | Zhang | B60K 35/00 340/425.5 |
| 8,762,041 | B2 * | 6/2014 | Lindner | G01C 21/3632 701/425 |
| 9,151,634 | B2 * | 10/2015 | Ann | G01C 21/36 |
| 2010/0328344 | A1 * | 12/2010 | Mattila | G06F 1/1626 345/633 |
| 2012/0212405 | A1 * | 8/2012 | Newhouse | G02B 27/017 345/156 |

(Continued)

FOREIGN PATENT DOCUMENTS

| | | |
|---|---|---|
| CN | 101903906 A | 12/2010 |
| CN | 102037326 A | 4/2011 |

(Continued)

OTHER PUBLICATIONS

Wikitude Navigation (Turn-by-turn)—Wikitude Dec. 2010 http://www.wikitude.com/showcase/wikitude-navigation.*

(Continued)

*Primary Examiner* — Eric M Blount
(74) *Attorney, Agent, or Firm* — Fenwick & West LLP

(57) ABSTRACT

A system and a method for providing augmented reality (AR) notification are provided. The system includes a recognizing unit configured to recognize a ground region, which is a region corresponding to the ground, on an AR driving image and a controller configured to add a display element to the ground region and to control a notification output associated with driving through the display element.

15 Claims, 9 Drawing Sheets

(56) References Cited

U.S. PATENT DOCUMENTS

| | | | | |
|---|---|---|---|---|
| 2013/0088514 | A1* | 4/2013 | Breuss-Schneeweis | G06T 19/006 345/633 |
| 2013/0194110 | A1 | 8/2013 | Kim et al. | |
| 2013/0293582 | A1* | 11/2013 | Ng-Thow-Hing | G06T 19/006 345/633 |
| 2014/0063064 | A1* | 3/2014 | Seo et al. | G08G 1/166 345/633 |
| 2014/0285523 | A1* | 9/2014 | Gruenler | G06T 19/006 345/633 |
| 2014/0362195 | A1* | 12/2014 | Ng-Thow-Hing | G06K 9/00791 348/51 |
| 2014/0368540 | A1* | 12/2014 | Iguchi | G06K 9/00832 345/633 |

FOREIGN PATENT DOCUMENTS

| | | | |
|---|---|---|---|
| CN | 102155953 | A | 8/2011 |
| CN | 102281348 | A | 12/2011 |
| CN | 103105171 | A | 5/2013 |
| KR | 20070019813 | A | 2/2007 |
| KR | 2008-0080691 | A | 9/2008 |
| KR | 20120067854 | A | 6/2012 |
| KR | 20130138522 | A | 12/2013 |

OTHER PUBLICATIONS

Pioneer Introduces Revolutionary Navgate Head-up Display for Easier Smartphone Navigation, Sep. 4, 2013, http://www.pioneer-car.eu/eur/news/pioneer-introduces-revolutionary-navgate-head-display-easier-smartphone-navigation.*

Sorrel, Charlie; TAPNAV Augmented Reality Navigation App Reads the Lane Ahead; Jun. 22, 2011; https://www.wired.com/2011/06/tapnav-augmented-reality-navigation-app-reads-the-lane-ahead.*

Goodwin, Antuan; Wikitude Drive for Android brings augmented reality to navigation -Roadshow; May 20, 2010; https://www.cnet.com/roadshow/news/wikitude-drive-for-android-brings-augmented-reality-to-navigation.*

First Office Action for Chinese Patent Application No. CN 201510423230.3, dated May 3, 2017, 17 pages.

* cited by examiner

SYSTEM AND METHOD FOR PROVIDING AUGMENTED REALITY NOTIFICATION

CROSS-REFERENCE TO RELATED APPLICATIONS

A claim for priority under 35 U.S.C. §119 is made to Korean Patent Application No. 10-2014-0090288 filed Jul. 17, 2014, in the Korean Intellectual Property Office, the entire contents of which are hereby incorporated by reference.

BACKGROUND

Embodiments of the inventive concepts described herein relate to technologies for providing notification information using Augmented Reality (AR).

A typical navigation terminal for vehicle is a system which embodies an Intelligent Transport System (ITS). The typical navigation terminal provides peripheral road situations to a driver of a vehicle by introducing position information using a Global Positioning System (GPS) satellite into the vehicle.

The typical navigation terminal detects position information of the vehicle using a satellite signal received from the GPS satellite, searches for previously stored map information using the detected position information, and displays a coordinate corresponding to the detected position information. As such, the typical navigation terminal provides map information relative to current position information of the vehicle such that the driver of the vehicle may receive detailed position information although a driving area is an unfamiliar area, thus increasing the convenience of the driver of the vehicle.

In addition, the navigation terminal guides the driver of the vehicle to prevent speeding in a speeding section by detecting cameras installed in a speed limit section in advance on a highway and informing the driver that a current driving section is the speed limit section. For example, Korean Patent Laid-Open Publication No. 2008-0080691 (Publication date, Sep. 5, 2008) discloses a "method for informing speed limit in a navigation terminal" which is technologies for calculating an average driving speed of a vehicle, which is being driven in a speed limit section, in real time, comparing the calculated average driving speed with a section speed limit, and providing warning notification when the average driving speed is over the section speed limit.

Meanwhile, Augmented Reality (AR) is one field of virtual reality and a computer graphic scheme for synthesizing virtual objects with a real environment to show the synthesized virtual objects like objects which are present in an original environment. AR supplements the real world and provides images in which a real environment and virtual objects are mixed, by overlapping and expressing virtual images with the real world. Therefore, AR may provide richer information to have a sense of reality by reinforcing additional information, which is difficult to be obtained in only the real world, to the real world.

AR technologies are applied in a navigation field. Recently, while a navigation terminal directly reproduces images of the real world captured by its camera on its monitor, it shows various driving information such as safe driving information, turn information, and distances using AR.

When there is a need for notification such as speeding or a caution on guiding driving, the navigation terminal guides driving states by displaying a separate pop-up window or applying a color reversal way or a color tone ON/OFF way to a driving guide screen.

However, a conventional method for expressing a driving state is an inefficient since a driving guide screen is hidden or a new design element is generated. Also, a navigation terminal using AR does not use characteristics and advantages of AR technologies properly.

Also, there is a conventional method for guiding a driving state on route lines depending on colors. However, this may be applied only when a route is set. When a vehicle is driven in a state where a route is not set, it is difficult to express a driving state in such a way that a route is set.

SUMMARY

Embodiments of the inventive concepts provide a system and method for providing Augmented Reality (AR) notification to effectively express notification information using intentions and characteristics of a navigation system using AR.

Embodiments of the inventive concepts provide a system and method for providing AR notification to guide notification information using AR irrespective of whether a route is set.

One aspect of embodiments of the inventive concept is directed to provide a system for providing Augmented Reality (AR). The system may include a recognizing unit configured to recognize a ground region, which is a region corresponding to the ground, on an AR driving image and a controller configured to add a display element to the ground region and to control a notification output associated with driving through the display element.

The recognizing unit may detect the horizon from the driving image and may recognize the ground region relative to the horizon.

The recognizing unit may detect a line from the driving image and may recognize the ground region relative to a vanishing point of the line.

The display element may include at least one of a color or a pattern which is applied to the ground region.

The display element may maintain transparency for the driving image.

The recognizing unit may recognize a driving state associated with at least one of a current driving speed of a vehicle or attributes of a road on which the vehicle is being driven. The controller may express a display element corresponding to the driving state on the ground region.

The recognizing unit may compare a current driving speed of a vehicle with the speed limit of a road on which the vehicle is being driven to recognize whether the vehicle is speeding. When the current driving speed is in a speeding driving state which is over the speed limit, the controller may express the ground region with a red color.

The recognizing unit may recognize attribute of a road on which a vehicle is being driven relative to a current position of the vehicle. When the vehicle enters a zone designated as a caution section, the controller may express the ground region with a yellow color.

The controller may add a pattern as the display element to the ground region and may express an effect in which the pattern moves in a driving direction of a vehicle in response to a driving speed of the vehicle.

The controller may maintain a state where the pattern is fixed while the vehicle is driven in a shadow section.

The system may further include a sensing unit configured to sense a turn point which is located in a certain distance ahead. The controller may expose destination information on a position of the turn point on the driving image.

The controller may express a rotation direction at the turn point and a remaining distance to the turn point on the position of the turn point.

The controller may express an effect in which the destination information is inversely expanded according to a remaining distance to the turn point and disappears at a time point when a vehicle passes through the turn point.

Another aspect of embodiments of the inventive concept is directed to provide a method for providing Augmented Reality (AR), implemented with a computer. The method may include recognizing a ground region, which is a region corresponding to the ground, on an AR driving image and adding a display element to the ground region and expressing notification associated with driving through the display element.

The recognizing of the ground region may include detecting the horizon from the driving image and recognizing the ground region relative to the horizon.

The display element may include at least one of a color or a pattern which is applied to the ground region.

The recognizing of the ground region may include recognizing a driving state associated with at least one of a current driving speed of a vehicle or attributes of a road on which the vehicle is being driven. The expressing of the notification may include expressing a display element corresponding to the driving state on the ground region.

The method may further include sensing a turn point which is located in a certain distance ahead. The expressing of the notification may include exposing destination information on a position of the turn point on the driving image.

The expressing of the notification may include expressing destination information, including a rotation direction at the turn point and a remaining distance to the turn point, on the position of the turn point and expressing an effect in which the destination information is inversely expanded according to a remaining distance to the turn point and disappears at a time point when a vehicle passes through the turn point.

Another aspect of embodiments of the inventive concept is directed to provide a non-transitory computer-readable medium to control a computer system, storing an instruction for controlling provision of notification. The non-transitory computer-readable medium may include recognizing a ground region, which is a region corresponding to the ground, on an Augmented Reality (AR) driving image and adding a display element to the ground region and expressing notification associated with driving through the display element.

BRIEF DESCRIPTION OF THE FIGURES

The above and other objects and features will become apparent from the following description with reference to the following figures, wherein like reference numerals refer to like parts throughout the various figures unless otherwise specified, and wherein.

DETAILED DESCRIPTION

Figure 1:
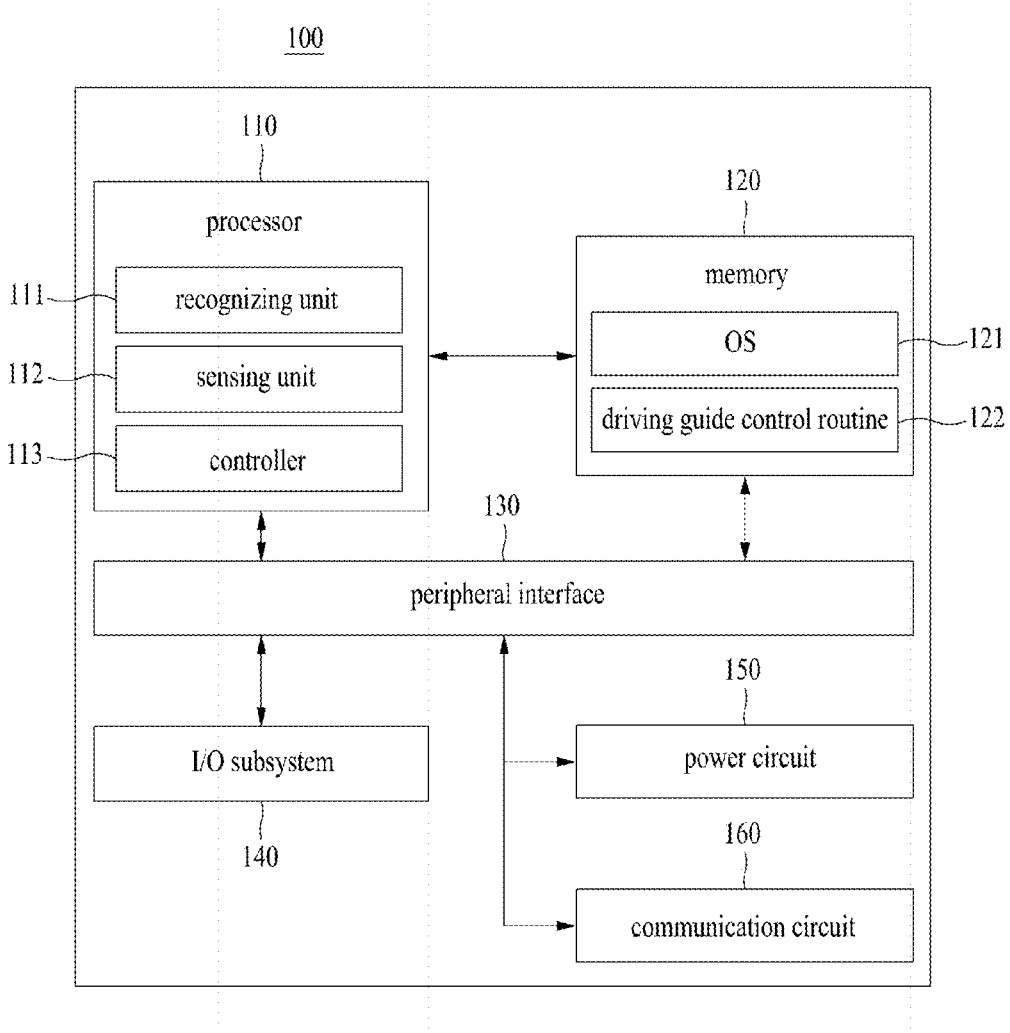
FIG. 1 is a block diagram illustrating a configuration of a computer system according to an exemplary embodiment.

Embodiments will be described in detail with reference to the accompanying drawings. The inventive concept, however, may be embodied in various different forms, and should not be construed as being limited only to the illustrated embodiments. Rather, these embodiments are provided as examples so that this disclosure will be thorough and complete, and will fully convey the concept of the inventive concept to those skilled in the art. Accordingly, known processes, elements, and techniques are not described with respect to some of the embodiments of the inventive concept. Unless otherwise noted, like reference numerals denote like elements throughout the attached drawings and written description, and thus descriptions will not be repeated. In the drawings, the sizes and relative sizes of layers and regions may be exaggerated for clarity.

It will be understood that, although the terms "first", "second", "third", etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the inventive concept.

Spatially relative terms, such as "beneath", "below", "lower", "under", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" or "under" other elements or features would then be oriented "above" the other elements or features. Thus, the exemplary terms "below" and "under" can encompass both an orientation of above and below. The device may be otherwise oriented (rotated 90 degrees or at other orientations) and the spatially relative descriptors used herein interpreted accordingly. In addition, it will also be understood that when a layer is referred to as being "between" two layers, it can be the only layer between the two layers, or one or more intervening layers may also be present.

The terminology used herein is for the purpose of describing particular embodiments only and is not intended to be limiting of the inventive concept. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Also, the term "exemplary" is intended to refer to an example or illustration.

It will be understood that when an element or layer is referred to as being "on", "connected to", "coupled to", or "adjacent to" another element or layer, it can be directly on, connected, coupled, or adjacent to the other element or layer, or intervening elements or layers may be present. In contrast, when an element is referred to as being "directly on," "directly connected to", "directly coupled to", or "immediately adjacent to" another element or layer, there are no intervening elements or layers present.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and/or the present specification and will not be interpreted in an idealized or overly formal sense unless expressly so defined herein.

Hereinafter, a description will be given in detail for exemplary embodiments of the inventive concept with reference to the accompanying drawings.

Exemplary embodiments of the inventive concept relate to a technology for expressing visual notification information in a driving guide environment using Augmented Reality (AR). The technology may be applied to an AR view mode of a navigation terminal.

FIG. 1 is a block diagram illustrating a configuration of a computer system according to an exemplary embodiment of the inventive concept.

As shown in FIG. 1, a computer system 100 may include at least one processor 110, a memory 120, a peripheral interface 130, an input/output (I/O) subsystem 140, a power circuit 150, and a communication circuit 160. In this case, the computer system 100 may correspond to a navigation system using AR.

Each of arrows shown in FIG. 1 may refer to facilitating communication and data transmission between components of the computer system 100. Each of the arrows may be configured using a high-speed serial bus, a parallel bus, a storage area network (SAN), and/or other proper communication technologies.

The memory 120 may include an operating system (OS) 121 and a driving guide control routine 122. For example, the memory 120 may include a high-speed random access memory (RAM), a magnetic disc, a static RAM (SRAM), a dynamic RAM (DRAM), a read only memory (ROM), a flash memory, or a nonvolatile memory. The memory 120 may store program codes for the OS 121 and the driving guide control routine 122. In other words, the memory 120 may include software modules, instruction sets, or various other data, which are necessary for operation of the computer system 100. In this case, when the processor 110 or another component such as the peripheral interface 130 accesses the memory 120 may be controlled by the processor 110.

The peripheral interface 130 may combine an input and/or output peripheral of the computer system 100 to the processor 110 and the memory 120. The I/O subsystem 140 may combine various I/O peripherals to the peripheral interface 130. For example, the I/O subsystem 140 may include a controller for combining a peripheral device, such as a monitor, a keyboard, a mouse, or a printer to the peripheral interface 130 or combining peripheral devices, such as a touch screen, a camera, or various sensors, to the peripheral interface 130 if necessary. According to another exemplary embodiment of the inventive concept, I/O peripherals may be combined to the peripheral interface 130 without the I/O subsystem 140.

The power circuit 150 may supply power to all or some of components of the computer system 100. For example, the power circuit 150 may include a power management system, one or more power supplies such as a battery or an alternating current (AC) power supply, a charging system, a power failure detection circuit, a power converter or an inverter, a power state indicator, or other components for power generation, management, and distribution.

The communication circuit 160 may facilitate communication with another computer system using at least one external port. Alternatively, as described above, if necessary, the communication circuit 160 may include a radio frequency (RF) circuit, and may facilitate communication with another computer system by transmitting and receiving a RF signal known as an electromagnetic signal.

The processor 110 may execute a software module or an instruction set which is stored in the memory 120, may perform various functions for the computer system 100, and may process data. The processor 110 may be configured to process instructions of a computer program by performing a basic arithmetic operation, a basic logic operation, and an input-output operation of the computer system 100. The processor 110 may be configured to execute program codes for a recognizing unit 111, a sensing unit 112, and a controller 113. This program codes may be stored in a recording device such as the memory 120.

The recognizing unit 111, the sensing unit 112, and the controller 113 may be configured to perform a method for providing AR notification described below.

FIG. 1 illustrates an example of the computer system 100. In the computer system 100, some of the components shown in FIG. 1 may be omitted. Additional components which are not shown in FIG. 1 may be further included in the computer system 100. The computer system 100 may have a configuration or arrangement for combining two or more components. For example, a computer system for a communication terminal of a mobile environment may further include a touch screen or a sensor, and the like, in addition to the components shown in FIG. 1. The communication circuit 160 may include a circuit for RF communication of various communication schemes (wireless-fidelity (Wi-Fi), 3 generation (3G), long term evolution (LTE), Bluetooth, near field communication (NFC), Zigbee, and the like). Components which may be included in the computer system 100 may be implemented with hardware, which includes an integrated circuit (IC) specialized for one or more signaling or applications, software, or combinations thereof.

A navigation system using AR, which has the above-described configurations, may overlap and express safe driving information, destination information, distance information, and the like on a driving image while reproducing a real driving image captured by its camera on its display.

Particularly, technologies for effectively expressing notification information using intentions and characteristics of the navigation system using AR according to an exemplary embodiment of the inventive concept may include a technology for expressing driving situations on a driving image and a technology for expressing approach to a turn point on a driving image.

First of all, a description will be given of the technology for expressing driving situations on a driving image.

Figure 2:
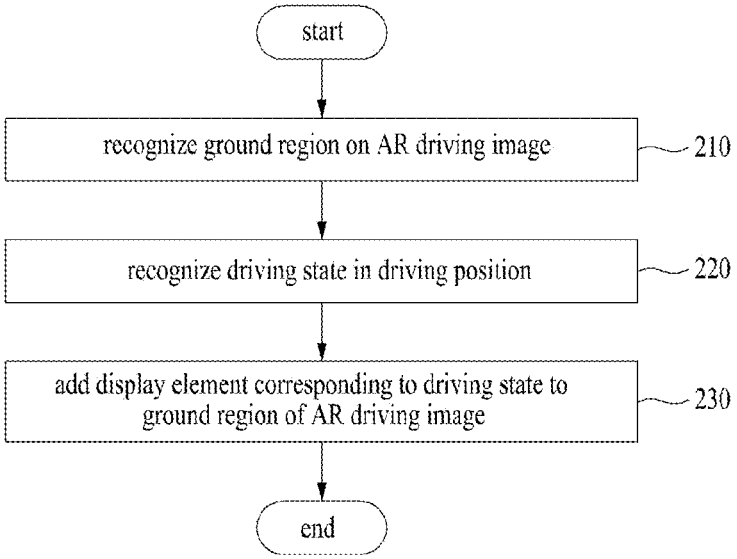
FIG. 2 is a flowchart illustrating an operation of a method for informing a driving state according to an exemplary embodiment.

FIG. 2 is a flowchart illustrating an operation of a method for informing a driving state according to an exemplary embodiment of the inventive concept. A method for informing a driving state according to an exemplary embodiment of the inventive concept may be performed by a recognizing unit 111 and a controller 113 which are components of a computer system 100 described with reference to FIG. 1.

Figure 3:
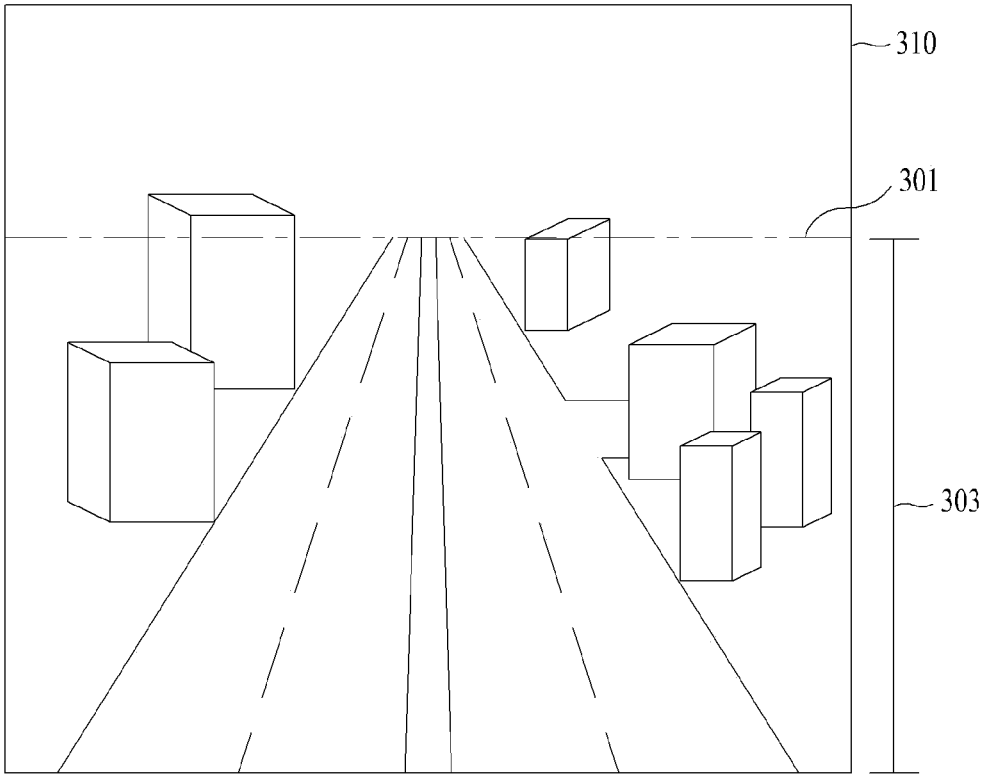
FIGS. 3 and 4 are drawings illustrating a way of detecting the horizon from an Augmented Reality (AR) driving image according to an exemplary embodiment.
Figure 4:
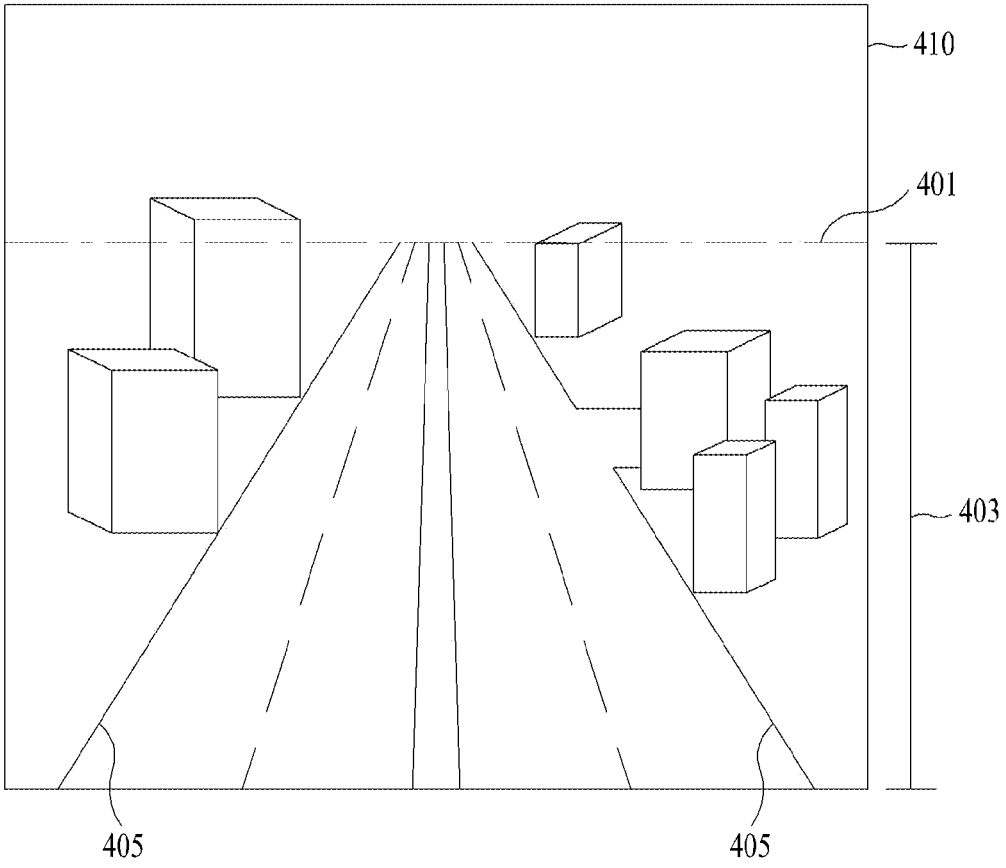

In step 210, the recognizing unit 111 may recognize a portion (hereinafter, referred to as a 'ground region') corresponding to the ground on a driving image using AR. In other words, the recognizing unit 111 may detect a ground region corresponding to a road from a real driving image captured by a camera. For one example, referring to FIG. 3, the recognizing unit 111 may detect the horizon 301 from the driving image 310 and may recognize a region 303 which is lower than the horizon 301 as a ground region. In this case, the horizon 301 may be determined according to an installation angle and a viewing angle of a camera. The horizon 301 may be detected using at least one or more of well-known horizon detection algorithms. For another example, referring to FIG. 4, the recognizing unit 111 may detect lines 405 from a driving image 410, may recognize the horizon 401 on the driving image 410 using vanishing points for the detected lines 405, and may recognize a region 403 which is lower than the horizon 401 as a ground region. In addition to the ways of recognizing the ground region, the ground region may be recognized through various ways such as a way of recognizing the ground region on a driving region using an image analysis technology.

In step 220, the recognizing unit 111 may recognize a driving state of a vehicle in a current driving position. For one example, the recognizing unit 111 may recognize a current driving speed of the vehicle and may compare the current driving speed of the vehicle with a predetermined speed limit of a road on which the vehicle is being driven to recognize whether the vehicle is speeding. For example, the recognizing unit 111 may recognize attributes of a road on which the vehicle is currently being driven. In other words, the recognizing unit 111 may recognize link attributes of a road corresponding to a current driving position. For example, the recognizing unit 111 may classify a driving state of a vehicle into a normal driving state and a speeding driving state according to a current driving speed of the vehicle. The recognizing unit 111 may classify a driving state of a vehicle into a caution section (e.g., a school zone, a silver zone, and the like) and a global positioning system (GPS) shadow section (e.g., an underground section, a tunnel section, and the like) according to attributes of a road on which the vehicle is being driven.

In step 230, the controller 113 may add display elements corresponding to driving states of a vehicle to a ground region of a driving image using AR to express driving states of notification, a caution, a warning, and the like. At least one of a color or a pattern may be used as a display element for expressing a driving state. In an exemplary embodiment of the inventive concept, a driving state may be classified and defined as, for example, a normal driving state, a speeding driving state, a caution section entry state, or a GPS shadow entry state in advance. A ground region may be expressed using a visual element suitable for each driving state to be matched with a characteristic of a color. In this case, the controller 113 may express a display element on a ground region other than the entire screen of a driving image. Particularly, the controller 113 may maintain certain transparency for a display element not to hide a driving image. The controller 113 may use a horizontal stripe pattern or a modified stripe pattern of a '∧' shape as a pattern which is one of display elements. The controller 113 may match a ground region with a real ground and may express a sense of distance using pattern line thickness of a pattern or spaces between lines of the pattern according to perspective. The controller 113 may express a sense of speed with an effect of moving together with corresponding patterns according to a driving speed. As described above, the controller 113 may match a characteristic of a color with a driving state to express the matched driving state. The controller 113 may express textures of a road as well as the sense of distance and the sense of speed through patterns.

Figure 5:
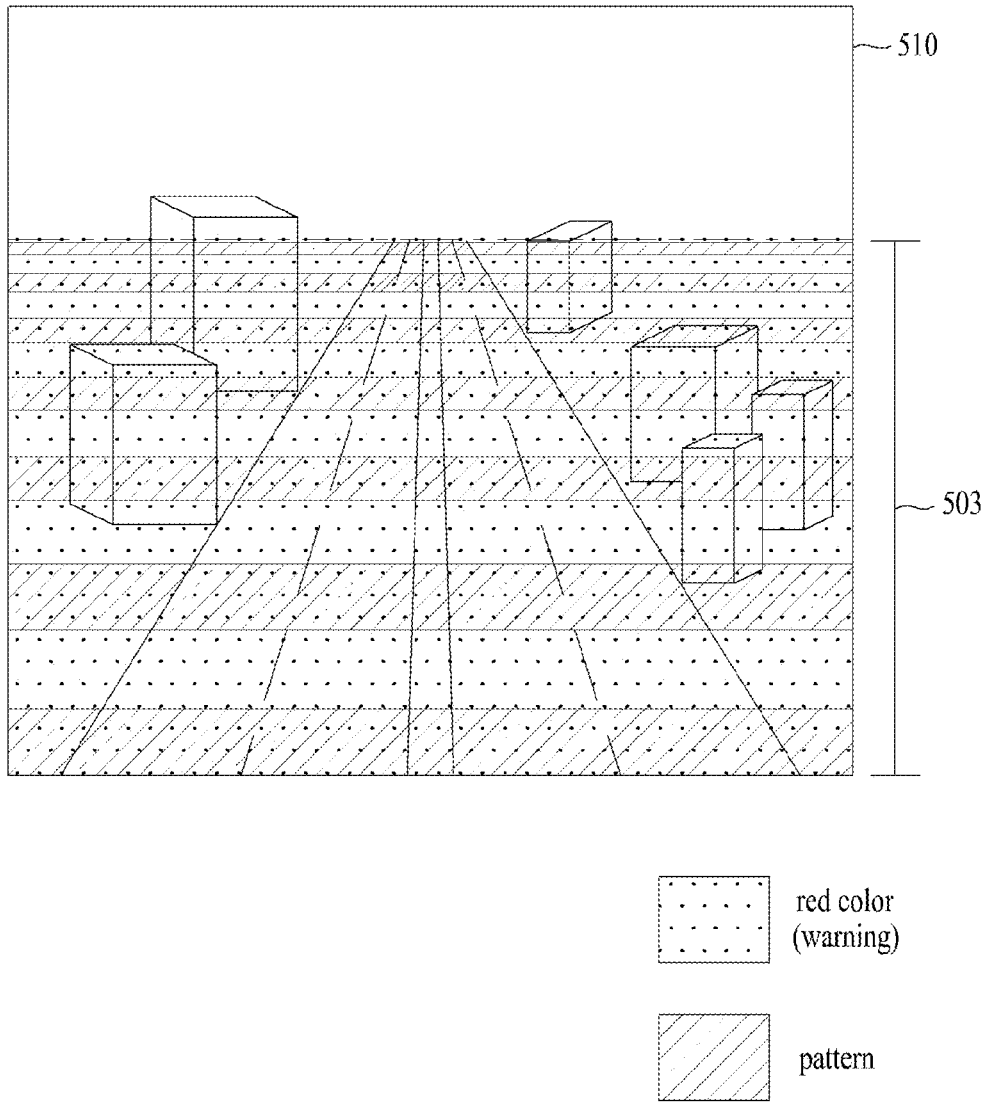
FIGS. 5 to 8 are drawings illustrating a way of expressing notification of a driving state on an AR ground region according to an exemplary embodiment.
Figure 6:
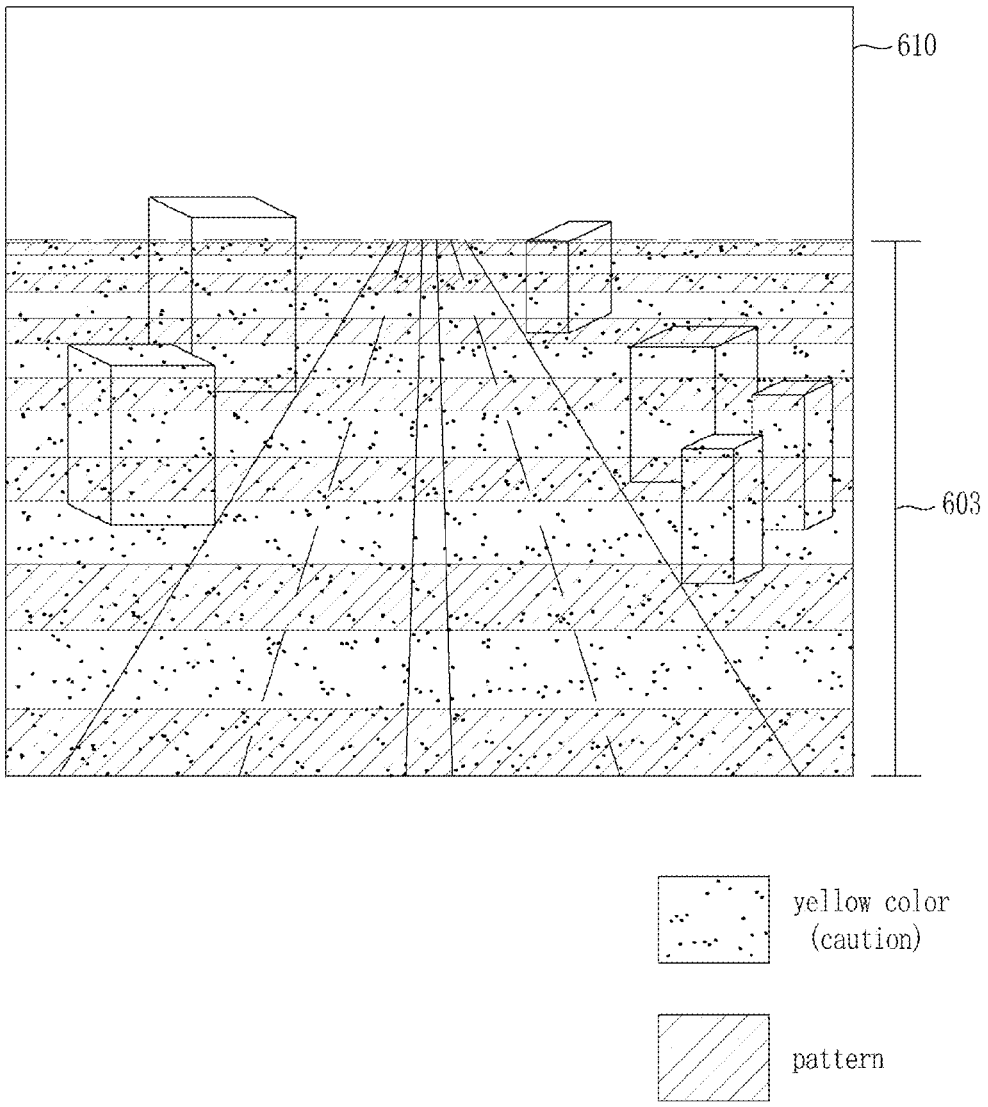
Figure 7:
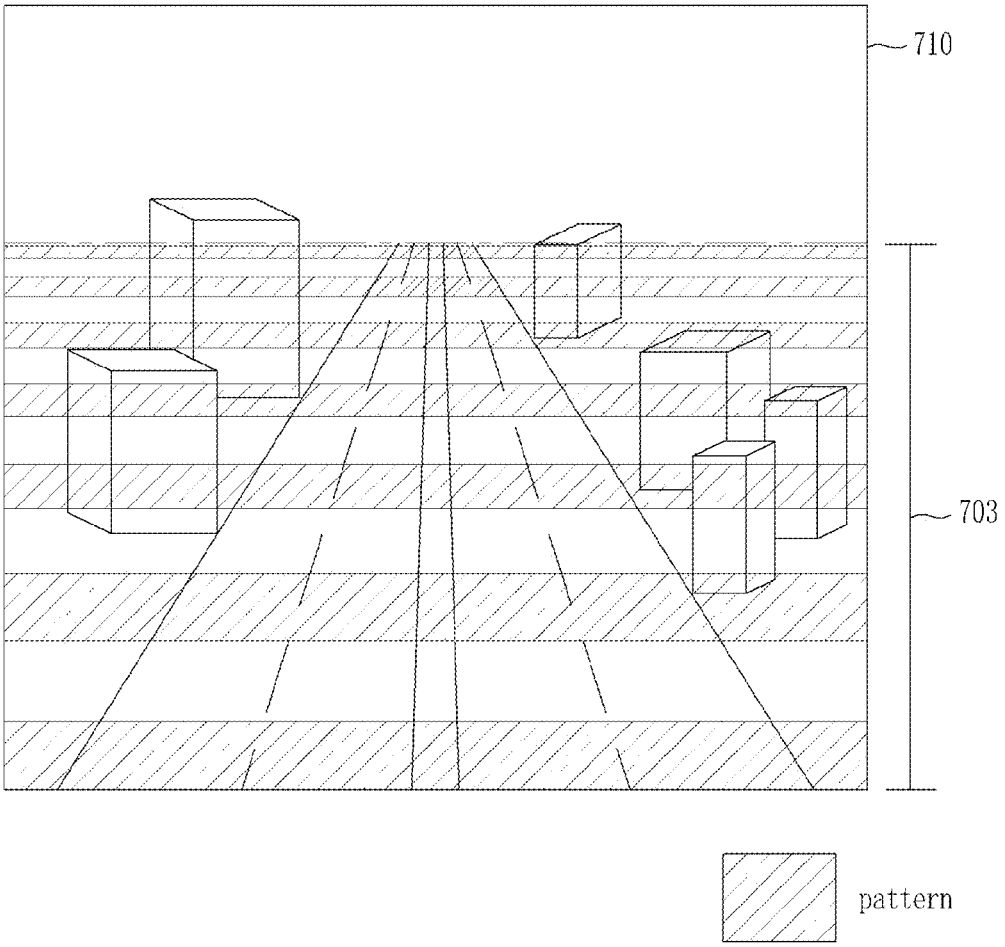

For example, as shown in FIG. 5, when a vehicle is currently speeding, the controller 113 may fill and express 'red color', which refer to a 'warning', on a ground region 503 of a driving image 510. The controller 113 may express a horizontal stripe pattern (a diagonal hatching portion of FIG. 5) to quickly move depending on a driving speed of the vehicle such that a driver of the vehicle may feel a sense of speed. In this case, when applying a specific color to the ground region 503 of the driving image 510, the controller 113 may apply color ON/OFF to the ground region 503 of the driving image 510 by frequency corresponding to a current speed of the vehicle. Also, as shown in FIG. 6, when the vehicle currently enters a school zone or a silver zone which requires caution, the controller 113 may fill and express 'yellow color', which refer to a 'caution', on a ground region of a driving image 610. As shown in FIG. 7, when the vehicle is in a normal driving state where the driver of the vehicle currently drives under the speed limit, the controller 113 may express only gray horizontal stripe patterns to move depending on a driving speed without applying a color to a ground region 703 of a driving image 710. Meanwhile, when the vehicle currently enters a GPS shadow section, the controller 113 may express that a GPS signal is smoothly not received by showing only the driving image 710 in a state where the gray horizontal stripe patterns are fixed without applying a color to the ground region 703 of the driving image 710.

According to the above-described exemplary embodiment of the inventive concept, the description is given of adding a display element corresponding to a driving state of a vehicle to the entire ground region under the horizon. However, the scope and spirit of the inventive concept may not be limited thereto. For example, another region suitable for expressing a driving state is specified on a driving image and a display element corresponding to a driving state of a vehicle may be added to the specified region.

Figure 8:
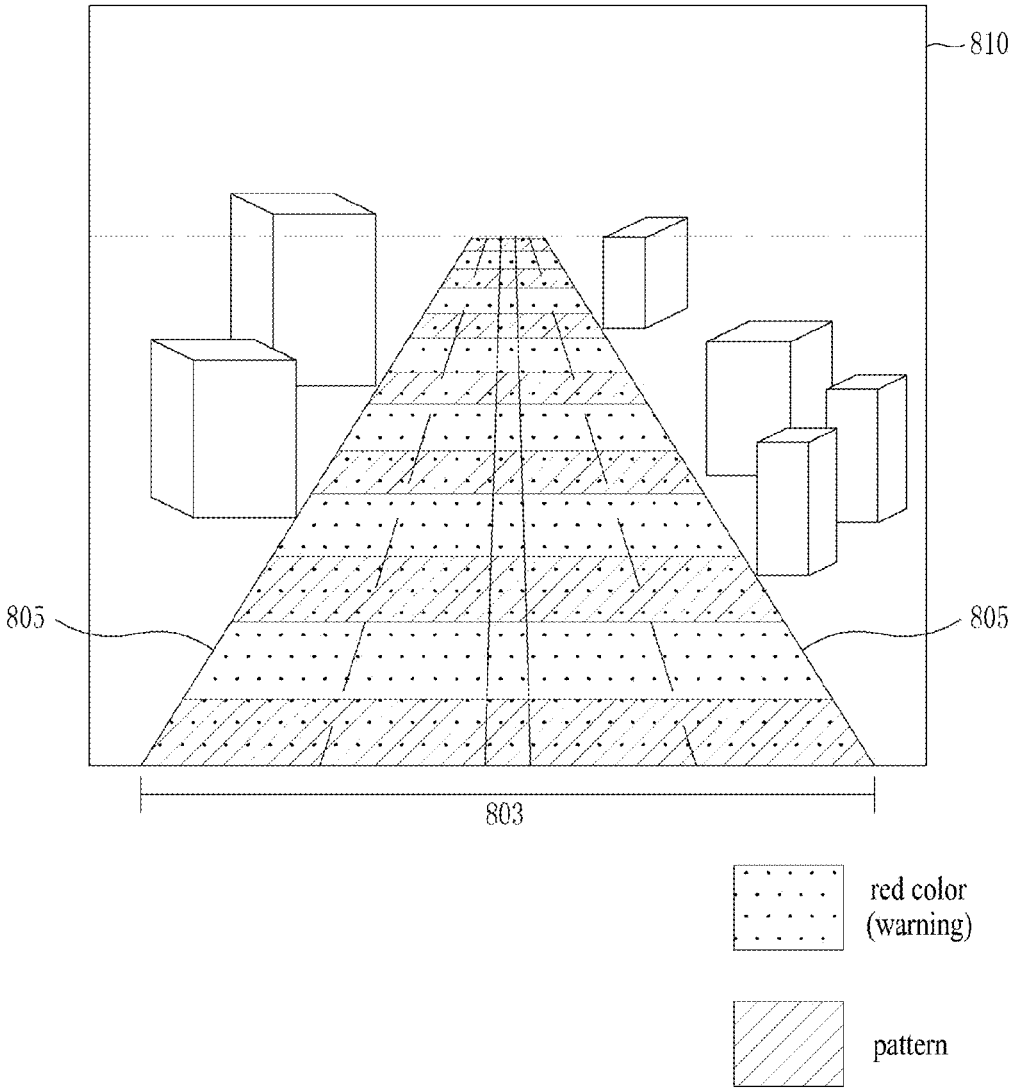

For example, as shown in FIG. 8, the controller 113 may add a display element (e.g., at least one of a color or a pattern) corresponding to a driving state of a vehicle to a portion 803 corresponding to a region between lines 805, that is, a real road region, relative to the lines 805 recognized on a driving image 810 to express a driving state such as notification, a caution, or a warning. In other words, the controller 13 may express a display element indicating a driving state (e.g., a normal driving state, a speeding driving state, a caution section entry state, a GPS shadow section entry state, and the like) on the road portion 803 which is a partial region other than the entire region of the driving image 810.

Therefore, according to an exemplary embodiment of the inventive concept, the computer system may provide a notification such as a caution or a warning about a driving state by expressing a display element corresponding to the driving state on a ground region of a driving image irrespective of whether a route is set.

Next, a description will be given of the technology for expressing approach to a turn point on a driving image.

Figure 9:
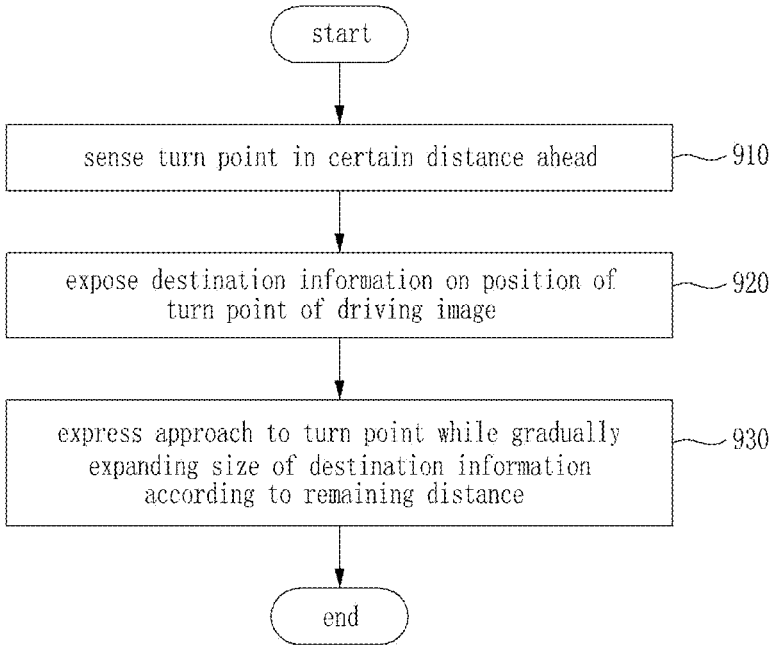
FIG. 9 is a flowchart illustrating an operation of a method for informing destination information according to an exemplary embodiment.

FIG. 9 is a flowchart illustrating an operation of a method for informing destination information according to an exemplary embodiment of the inventive concept. A method for informing destination information according to an exemplary embodiment of the inventive concept may be performed by a sensing unit 112 and a controller 113 which are components of a computer system 100 described with reference to FIG. 1.

In step 910, when a route is set on a navigation system, the sensing unit 112 may sense a turn point included in the route relative to a current position of a vehicle. In other words, the sensing unit 112 may sense a turn point which is located in a certain distance ahead of the vehicle while the vehicle is driven on the set route.

Figure 10:
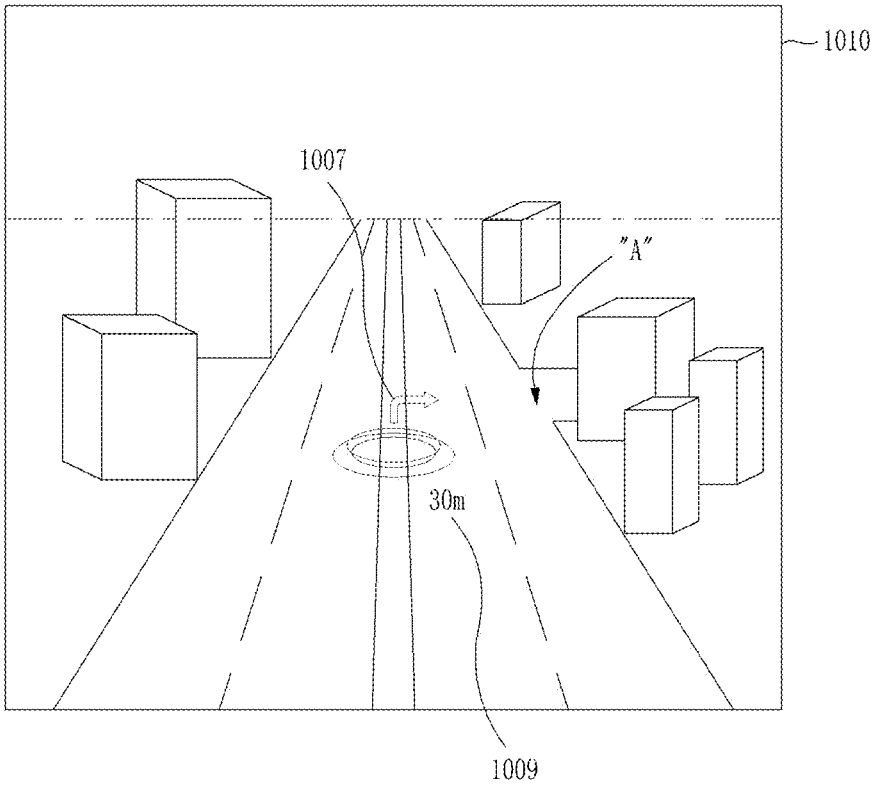
FIGS. 10 and 11 are drawings illustrating a way of expressing destination information on an AR turn point according to an exemplary embodiment.

In step 920, when a turn point is sensed on the set route ahead, the controller 113 may expose a display element indicating destination information on a position of the turn point of a driving image. For example, as shown in FIG. 10, when it is necessary for guiding a right turn at a front turn point A through a driving image 1010, the controller 113 may overlap and express display elements indicating a rotation direction 1007 at the turn point A and a remaining distance 1009 to the turn point A near the turn point A of the driving image 1010.

Figure 11:
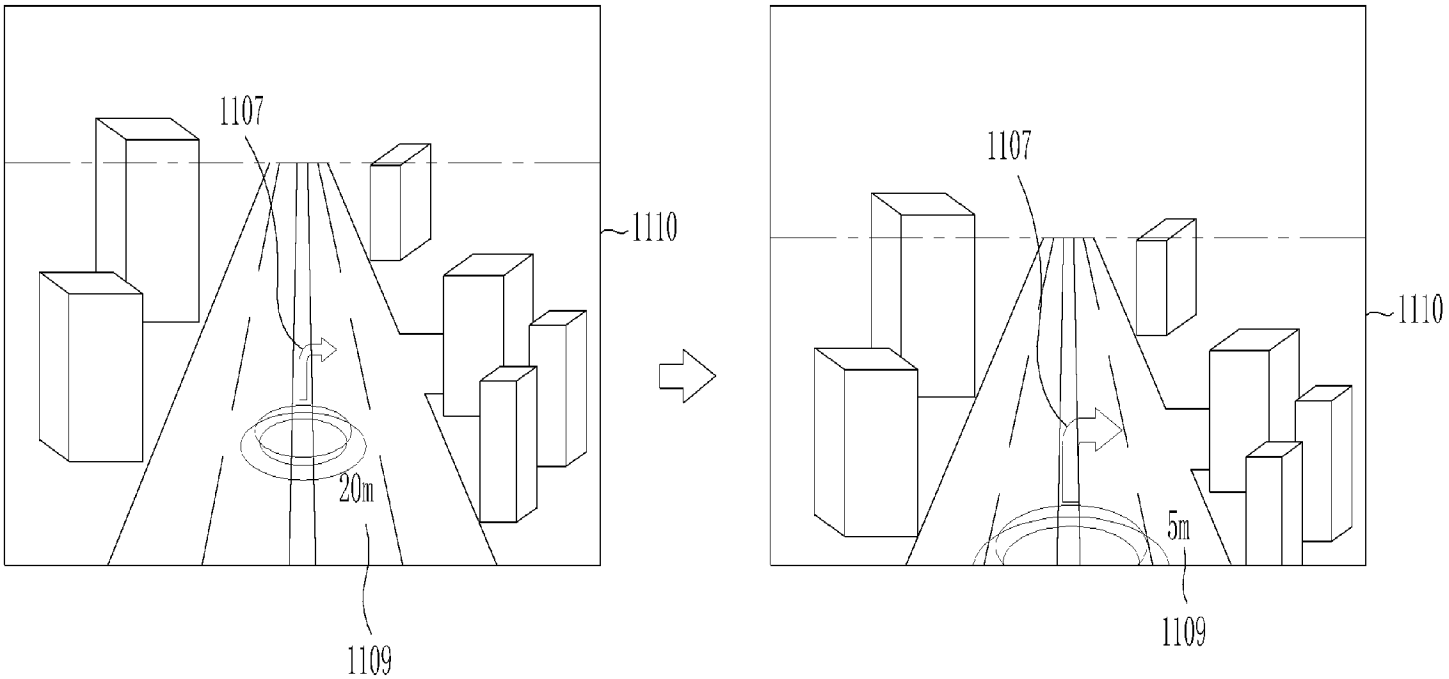

In step 930, the controller 113 may vary a display element indicating destination information depending on driving of a vehicle to express approach to a turn point on a driving image. For example, as shown in FIG. 11, the controller 113 may guide approach to a turn point by gradually expanding and expressing destination information on a driving image 1110, that is, a rotation direction 1107 at the turn point and a remaining distance 1109 to the turn point in a size which is in inverse proportion to the remaining distance 1109. In this case, the destination information expressed on the driving image 1110 may be implemented to disappear from the driving image 1110 at a time point when a vehicle passes through the turn point.

Therefore, according to an exemplary embodiment of the inventive concept, the computer system may overlap and express destination information about a turn point with a driving image when a vehicle approaches to the turn point included in a route within a certain distance. Also, the computer system may express gradual approach to a turn point in a real way by inversely expanding destination information according to a remaining distance to the turn point depending on driving of a vehicle and expressing the destination information to gradually come closer and disappear to and from a driver of the vehicle.

Methods according to exemplary embodiments of the inventive concept may be implemented with program instructions which may be performed through various computer systems and may be recorded in a non-transitory computer-readable medium. Also, a program according to an exemplary embodiment of the inventive concept may be configured with a personal computer (PC)-based program or a mobile terminal dedicated application.

As such, according to exemplary embodiments of the inventive concept, the computer system effectively express notification information using intentions and characteristics of a navigation system using AR by expressing notification associated with driving using AR irrespective of whether a route is set. Also, according to exemplary embodiments of the inventive concept, the computer system may minimize a sense of difference and may provide a more natural visual effect by expressing notification information associated with driving in such a way to be matched with an AR real road.

The foregoing devices may be realized by hardware elements, software elements and/or combinations thereof. For example, the devices and components illustrated in the exemplary embodiments of the inventive concept may be implemented in one or more general-use computers or special-purpose computers, such as a processor, a controller, an arithmetic logic unit (ALU), a digital signal processor, a microcomputer, a field programmable array (FPA), a programmable logic unit (PLU), a microprocessor or any device which may execute instructions and respond. A processing unit may implement an operating system (OS) or one or software applications running on the OS. Further, the processing unit may access, store, manipulate, process and generate data in response to execution of software. It will be understood by those skilled in the art that although a single processing unit may be illustrated for convenience of understanding, the processing unit may include a plurality of processing elements and/or a plurality of types of processing elements. For example, the processing unit may include a plurality of processors or one processor and one controller. Alternatively, the processing unit may have a different processing configuration, such as a parallel processor.

Software may include computer programs, codes, instructions or one or more combinations thereof and configure a processing unit to operate in a desired manner or independently or collectively control the processing unit. Software and/or data may be permanently or temporarily embodied in any type of machine, components, physical equipment, virtual equipment, computer storage media or units or transmitted signal waves to be interpreted by the processing unit or to provide instructions or data to the processing unit. Software may be dispersed throughout computer systems connected via networks and be stored or executed in a dispersion manner. Software and data may be recorded in one or more computer-readable storage media.

The methods according to the above-described exemplary embodiments of the inventive concept may be implemented with program instructions which may be executed by various computer means and may be recorded in computer-readable media. The computer-readable media may also include, alone or in combination with the program instructions, data files, data structures, and the like. The program instructions recorded in the media may be designed and configured specially for the exemplary embodiments of the inventive concept or be known and available to those skilled in computer software. Non-transitory computer-readable media may include magnetic media such as hard disks, floppy disks, and magnetic tape; optical media such as CD ROM disks and DVDs; magneto-optical media such as floptical disks; and hardware devices which are specially configured to store and perform program instructions, such as a read-only memory (ROM), a random access memory (RAM), a flash memory, and the like. Program instructions may include both machine codes, such as produced by a compiler, and higher-level language codes which may be executed by the computer using an interpreter. The described hardware devices may be configured to act as one or more software modules to perform the operations of the above-described exemplary embodiments of the inventive concept, or vice versa.

While a few exemplary embodiments have been shown and described with reference to the accompanying drawings, it will be apparent to those skilled in the art that various modifications and variations can be made from the foregoing descriptions. For example, adequate effects may be achieved even if the foregoing processes and methods are carried out in different order than described above, and/or the aforementioned elements, such as systems, structures, devices, or circuits, are combined or coupled in different forms and modes than as described above or be substituted or switched with other components or equivalents.

Therefore, other implements, other embodiments, and equivalents to claims are within the scope of the following claims.

What is claimed is:

1. A system for providing augmented reality (AR) notification, the system comprising:

a recognizing unit configured to recognize a ground region, which is a region corresponding to the ground, on an AR driving image; and a controller configured to add a display element to the ground region and to control a notification output associated with driving through the display element, wherein the recognizing unit recognizes a driving state associated with a current driving speed of a vehicle, and wherein the display element comprises a pattern applied to the ground region and the controller adjusts the pattern which is applied to the ground region based on the driving state independently of a user-selected route, wherein the pattern of only the ground region of the AR driving image is visually changed, and wherein the controller adjusts the pattern based on the current driving speed such that the pattern is visually moved in a driving direction of the vehicle in accordance with the current driving speed.

2. The system of claim 1, wherein the recognizing unit detects a horizon from the driving image and recognizes the ground region relative to the horizon.

3. The system of claim 1, wherein the recognizing unit detects a line from the driving image and recognizes the ground region relative to a vanishing point of the line.

4. The system of claim 1, wherein the display element maintains transparency for the driving image.

5. The system of claim 1, wherein the recognizing unit compares a current driving speed of a vehicle with the speed limit of a road on which the vehicle is being driven to recognize whether the vehicle is speeding, and wherein when the current driving speed is in a speeding driving state which is over the speed limit, the controller expresses the ground region with a red color.

6. The system of claim 1, wherein the recognizing unit recognizes attributes of a road on which a vehicle is being driven relative to a current position of the vehicle, and wherein when the vehicle enters a zone designated as a caution section, the controller expresses the ground region with a yellow color.

7. The system of claim 1, wherein the controller adjusts the pattern which is moving in accordance with the driving speed to stop when the vehicle is driven in a global positioning system (GPS) shadow section where the GPS functionality of the vehicle is unstable.

8. The system of claim 1, further comprising:

a sensing unit configured to sense a turn point which is located in a certain distance ahead, wherein the controller exposes destination information on a position of the turn point on the driving image.

9. The system of claim 8, wherein the controller expresses a rotation direction at the turn point and a remaining distance to the turn point on the position of the turn point.

10. The system of claim 8, wherein the controller expresses an effect in which the destination information is inversely expanded according to a remaining distance to the turn point and disappears at a time point when a vehicle passes through the turn point.

11. A method for providing augmented reality (AR) notification, implemented with a computer, the method comprising:

recognizing a ground region, which is a region corresponding to the ground, on an AR driving image; and adding a display element to the ground region and expressing notification associated with driving through the display element, wherein the recognizing recognizes a driving state associated with a current driving speed of a vehicle, and wherein adding the display element comprises adjusting a pattern which is applied to the ground region based on the driving state independently of a user-selected route, wherein the pattern of only the ground region of the AR driving image is visually changed, and wherein the pattern is adjusted based on the current driving speed such that the pattern is visually moved in a driving direction of the vehicle in accordance with the current driving speed.

12. The method of claim 11, wherein the recognizing of the ground region comprises:

detecting a horizon from the driving image; and recognizing the ground region relative to the horizon.

13. The method of claim 11, further comprising:

sensing a turn point which is located in a certain distance ahead, wherein the expressing of the notification comprises:

exposing destination information on a position of the turn point on the driving image.

14. The method of claim 13, wherein the expressing of the notification comprises:

expressing destination information, including a rotation direction at the turn point and a remaining distance to the turn point, on the position of the turn point; and expressing an effect in which the destination information is inversely expanded according to a remaining distance to the turn point and disappears at a time point when a vehicle passes through the turn point.

15. A non-transitory computer-readable medium to control a computer system, storing an instruction for controlling provision of notification, comprising:

recognizing a ground region, which is a region corresponding to the ground, on an augmented reality (AR) driving image; and adding a display element to the ground region and expressing notification associated with driving through the display element, wherein the recognizing recognizes a driving state associated with a current driving speed of a vehicle, and wherein adding the display element comprises adjusting a pattern which is applied to the ground region based on the driving state independently of a user-selected route, wherein the pattern of only the ground region of the AR driving image is visually changed, and wherein the pattern is adjusted based on the current driving speed such that the pattern is visually moved in a driving direction of the vehicle in accordance with the current driving speed.

* * * * *